United States Patent [19]

Lu

[11] 4,373,131

[45] Feb. 8, 1983

[54] APPARATUS FOR FLASH FUSING TUNER IMAGES

[75] Inventor: Wei C. Lu, Rochester, N.Y.

[73] Assignee: Eastman Kodak Company, Rochester, N.Y.

[21] Appl. No.: 354,877

[22] Filed: Mar. 4, 1982

Related U.S. Application Data

[62] Division of Ser. No. 189,492, Sep. 22, 1980, Pat. No. 4,341,854.

[51] Int. Cl.[3] ..... H05B 1/02

[52] U.S. Cl. ..... 219/216; 219/354; 430/97; 430/124

[58] Field of Search ..... 219/214, 216, 219, 220, 219/347, 349, 354, 388; 264/25; 430/97, 110, 124; 432/59, 121

[56] References Cited

U.S. PATENT DOCUMENTS

| | | | |
|---|---|---|---|
| 2,965,573 | 12/1960 | Gundlach | 430/110 |
| 3,591,767 | 7/1971 | Mudie | 219/354 |
| 3,893,935 | 7/1975 | Jadwin et al. | 430/110 |
| 3,975,618 | 8/1976 | Goos et al. | 219/388 |
| 4,179,600 | 12/1979 | Haberhauer | 219/216 |
| 4,205,220 | 5/1980 | O'Brien | 219/216 |

*Primary Examiner*—Volodymyr Y. Mayewsky
*Attorney, Agent, or Firm*—Lawrence P. Kessler

[57] ABSTRACT

Fusing both small and large image areas of dry resinous marking particles supported on the surface of a receiver member by irradiating the particles with energy to at least partially melt the particles at the interface between the particles and receiver member. Fusing is accomplished by directing the energy from an energy source toward the surface of the particle-supporting receiver member along a path having a major low-angle component relative to the receiver member. The particles are irradiated over a substantial portion of their surface area, with energy which is not reflected by the receiver member and with energy which has been reflected by the receiver member. A sufficient amount of energy is thus received to at least partially melt the particles at the interface between the particles and receiver member so that the particles adhere to the receiver member.

3 Claims, 3 Drawing Figures

PRIOR ART
FIG. 1
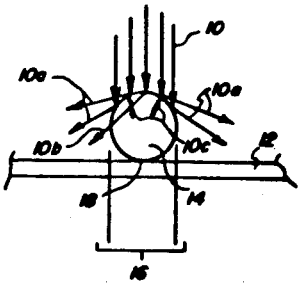
PRIOR ART
FIG. 2
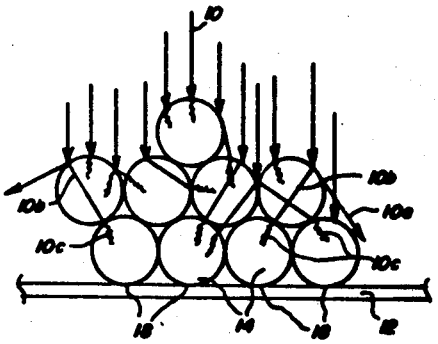
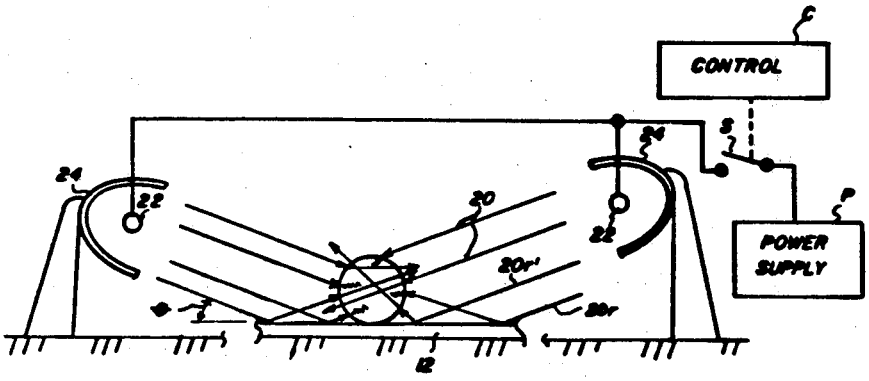
FIG. 3

APPARATUS FOR FLASH FUSING TUNER IMAGES

This is a division of application Ser. No. 189,492, filed Sept. 22, 1980, now U.S. Pat. No. 4,341,854.

BACKGROUND OF THE INVENTION

This invention relates generally to fusing of toner images in an electrostatographic process and more particularly to flash fusing toner images on a receiver member using infrared radiation directed along a path having a major low-angle component relative to such member.

In a typical electrostatographic process, a latent electrostatic charge image on a photoconductive member is developed by contacting the charge image with a colorant (toner) in the form of dry resinous marking particles. The particles are electrostatically charged in an opposite sense to the latent charge image and adhere to the photoconductive member to form a visible imagewise distribution of marking particles corresponding to the latent charge image. The visible imagewise distribution of particles is then transferred to the surface of a receiver member. Subsequently, the transferred particles are fixed (fused) to the receiver member. The fusing operation is accomplished by application of energy (such as heat and/or pressure) or solvent vapor to the particles and the member. The energy, or solvent vapor, at least partially melts the toner particles so that the melted portion adheres to the surface of the member. For example, when the receiver member is a sheet of paper, the melted portion is imbibed into the surface fibers of the sheet. Thus when the particles re-solidify, they are fixed to the sheet.

One method of fusing the marking particles involves directing a burst of radiant energy onto the particles and receiver member; see for example, U.S. Pat. No. 4,205,220 issued May 27, 1980, in the name of O'Brien and assigned to a common assignee. This method, referred to as flash fusing, has had limited commercial application because different energy levels have heretofore been required to adequately fix line images and large area images, making the simultaneous fixing of line and large area images difficult. The apparent reason for needing different energy levels is that the source of radiant energy, at a particular energy level below the level which burns the receiver member, is arranged to direct energy normal to the receiver member. The energy striking the upper portion of marking particle surfaces on the receiver member, is absorbed by the particles but the remainder is reflected or refracted into the environs. A large solid area of particles accumulates sufficient radiant energy from direct and refracted radiation to melt the particles in the solid area. However, small area (line) images or single particles only accumulate direct radiation since the reflected and refracted radiation travels away from the area or particle and is dissapated. Thus, while the top of a particle melts the part in contact with the member does not. Heat loss due to convection cooling at the interface between the particle and the receiver member does not allow sufficient melting of the particle for the particle to adhere to the surface of the receiver member.

SUMMARY OF THE INVENTION

This invention is directed to apparatus and method for fusing both small and large image areas of dry resinous marking particles supported on the surface of a receiver member, by irradiating the particles with energy to at least partially melt the particles at the interface between the particles and receiver member. Fusing according to this invention is accomplished by directing the energy from an energy source toward the surface of the particle-supporting receiver member along a path having a major low-angle component relative to the receiver member. The particles are irradiated, over a substantial portion of their surface area, with energy which is not reflected by the receiver member and with energy which has been reflected by the receiver member. A sufficient amount of energy is thus received to at least partially melt the particles at the interface between the particles and receiver member so that the particles adhere to the receiver member. In another aspect of this invention, the energy source is at least one lamp which emits infrared energy. In still another aspect of this invention the energy source includes elongate parallel flash lamps which emit energy having wavelengths in the infrared range.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which:

FIGS. 1 and 2 are schematic side elevational views of prior art methods for application of radiant energy for fusing areas of single and multiple dry resinous marking particles respectively; and FIG. 3 is a schematic side elevational view of fusing a dry resinous marking particle according to this invention by application of radiant energy directed along a path having a major low-angle component relative to the particle-supporting receiver member.

DESCRIPTION OF THE PREFERRED EMBODIMENT

As best shown in FIGS. 1 and 2, when the prior art flash fusing methods have been employed in an electrostatographic process for fusing images formed of dry resinous marking particles on the surface of a receiver member such as a paper sheet, an energy source is located to direct radiant energy 10 substantially normal to the receiver member 12. As a result only the top portion of marking particles 14 (shown on a relatively enlarged scale) are directly irradiated. Of the radiant energy striking the particles 14, some (10*a*) is reflected by the particles, some (10*b*) is refracted by (deflected on passage through) the particles, and some (10*c*) is absorbed in the particles to produce heat. The particles 14 are typically pigmented thermoplastic resin such as described in U.S. Pat. No. 3,893,935, issued July 8, 1975 in the name of Jadwin et al. The portion of the energy producing heat causes at least partial melting of the particles. When the melting occurs at the particle/-receiver member interface, the melted particles adhere to the surface of the receiver member and become fixed to the member when the particles cool and re-solidify.

When the image to be fused is comprised of many particles covering a substantially large area on the surface of the receiver member, as for example in FIG. 2, some of the reflected and refracted (scattered) energy may strike other adjacent particles to be absorbed to produce heat; the scattered energy not striking any particles is not available for heat production. As is apparent from FIG. 1 however, with a single marking particle (or a relatively small distribution of particles, as would be the case in an image of line copy), only that portion of the normal radiant energy directly striking the particle is absorbed to produce heat. In fact, the upper segment of the particle forms a shadow area, designated by the numeral 16, over the lower segment of the particle so that the lower segment does not receive direct radiant energy. Consequently, initial heating occurs only over the upper segment of the particle. Due to convection cooling in the vicinity of the interface 18 between the particle and the receiver member 12, the particle may not melt sufficiently for the particle to adhere to the surface of the receiver member.

Flash fusing according to this invention, is accomplished as depicted in FIG. 3, the dry resinous marking particle 14 being shown on a relatively enlarged scale. Radiant energy 20 is directed toward the surface of the particle-supporting receiver member 12 along a path having a major low-angle component relative to the member designated generally by the angle $\theta$. The receiver member 12 is typically a sheet of paper which reflects radiant energy. The radiant energy preferably is supplied by elongate parallel flash lamps 22, emitting energy in at least the infrared range, which readily converts to heat within the particles. For example, the lamps 22 may be Xenon flash lamps (emitted energy includes wavelengths in the infrared range). The lamps are electrically connected through a switch S to a power supply P of a magnitude in the range of 300 to 2400 joules (in some embodiments the range of 600 to 1230 joules has been shown particularly effective). A control C selectively closes the switch S for a time duration to establish a flash pulse width of 0.125 to 2000 msec (in some embodiments the range of 1.2 to 13.7 msec has been shown particularly effective). The lamps are positioned within respective elliptical reflectors 24, which are supported relative to the plane of the receiver member so that the major low-angle path component angle $\theta$ of the radiant energy is between 15° and 45° relative to the receiver member. Thus, in addition to the radiant energy directly striking the particle, some of the energy (20 r) striking the receiver member is reflected by the member to strike the particle. Of course some parallel radiation (20 $r^1$) is reflected from the member at different angles because of surface irregularities of the member. Therefore, a greater percentage of the surface area of the particle is irradiated. Alternatively, if the energy source is supported relative to the plane of the receiver member so that the major path component is not at a low angle with respect to the member, mirrors could be provided to redirect (reflect) the radiant energy at the member with the major low-angle path component relative to the member.

While reflection and refraction of some of the radiant energy incident to the particle occurs in the same proportions as before, more radiant energy strikes the particle and there is therefore a correspondingly greater percentage of energy available to be absorbed to produce heat. Of course, the more energy absorbed by the particle to produce heat, the more complete its melting at the interface between the particles and receiver member and the more readily the particle adheres to the receiver member. This is true, of course, as long as the amount of radiation is kept below the level at which the particle vaporizes or the member burns. Although the description relative to FIG. 3 speaks of fusing a single marking particle, because radiant energy is directed toward the surface of the receiver member, a similar increase proportion of the radiant energy is also available to be absorbed to produce heat for fusing spaced particles or for fusing at the edges of large image area particle groups. The main body of particles in the large image area groups receives sufficient direct and scattered radiant energy for adequate fusing as described above with reference to the prior art methods. Accordingly, a radiation source of one energy level provides adequate fusing of both single marking particles and large image area particle groups.

The invention has been described in detail with particular reference to preferred embodiments thereof, but it will be understood that variations and modifications can be effected within the spirit and scope of the invention.

I claim:

1. Apparatus for fusing dry resinous marking particles on the surface of an energy reflective receiver member, said apparatus comprising:

means for producing radiant energy capable of at least partially melting said dry resinous marking particles;

means for supporting said radiant energy producing means with respect to said receiver member so that the radiant energy striking the marking particles and the receiver member from opposite sides is directed toward the surface of said receiver member along a path having a major low-angle component relative to the receiver member; and means for activating said radiant energy producing means to sufficiently irradiate a substantial portion of the surface area of the marking particles with radiant energy which has not been reflected by the receiver member and with radiant energy which has been reflected by the receiver member to fuse the marking particles to each other and to the surface of the receiver member.

2. The invention of claim 1 wherein said radiant energy producing means includes at least one lamp which emits infrared energy.

3. The invention of claim 1 wherein said radiant energy producing means includes elongate parallel flash lamps which emit radiant energy having wavelengths in the infrared range.

* * * * *